US010575079B2

(12) United States Patent
Okano

(10) Patent No.: US 10,575,079 B2
(45) Date of Patent: Feb. 25, 2020

(54) SPEAKER DEVICE

(71) Applicant: Onkyo Corporation, Osaka (JP)

(72) Inventor: Shuji Okano, Tokyo (JP)

(73) Assignee: ONKYO CORPORATION, Osaka (JP)

( * ) Notice: Subject to any disclaimer, the term of this patent is extended or adjusted under 35 U.S.C. 154(b) by 0 days.

(21) Appl. No.: 16/108,111

(22) Filed: Aug. 22, 2018

(65) Prior Publication Data

US 2019/0069061 A1 Feb. 28, 2019

(30) Foreign Application Priority Data

Aug. 29, 2017 (JP) ..... 2017-164334

(51) Int. Cl.
*H04R 1/08* (2006.01)
*H04R 1/02* (2006.01)

(52) U.S. Cl.
CPC ..... *H04R 1/08* (2013.01); *H04R 1/025* (2013.01); *H04R 1/086* (2013.01); *H04R 2410/03* (2013.01)

(58) Field of Classification Search
CPC ..... H04R 1/025; H04R 1/08; H04R 2410/03
USPC ..... 381/56, 113, 332, 351, 355, 401, 423
See application file for complete search history.

(56) References Cited

U.S. PATENT DOCUMENTS 6,904,298 B2 * 6/2005 Arai ..... H04N 5/2252 348/14.01
7,676,053 B2 * 3/2010 Nagaoka ..... H04R 9/025 381/401
7,835,538 B2 * 11/2010 Inoue ..... H04R 9/045 381/423
8,817,971 B2 * 8/2014 Shida ..... H05K 7/20336 379/433.02
9,390,724 B2 7/2016 List
9,706,306 B1 * 7/2017 List ..... H04R 5/02
9,871,901 B2 * 1/2018 Hiramatsu ..... H04R 1/2892
10,123,119 B1 * 11/2018 List ..... H04R 5/02
2003/0035558 A1 * 2/2003 Kawamura ..... H04R 19/005 381/113
2007/0165895 A1 * 7/2007 Matsumura ..... H04R 1/2803 381/351
2010/0290660 A1 * 11/2010 Fukuda ..... H04R 7/122 381/355

(Continued)

FOREIGN PATENT DOCUMENTS

JP 2012-235264 A 11/2012

*Primary Examiner* — Paul Kim
*Assistant Examiner* — Friedrich Fahnert
(74) *Attorney, Agent, or Firm* — Xsensus LLP

(57) ABSTRACT

According to the present invention, in a speaker device including a microphone, sound propagating from a speaker unit to the microphone through a housing is effectively reduced, and noise picked up by the microphone is reduced. The speaker device includes the housing configured to support the speaker unit, and a film-shaped elastic body configured to support the microphone. The housing includes a holding portion configured to hold the elastic body with a distance from the microphone. The elastic body has a through-hole, a support portion on which the microphone is supported is provided around the through-hole on one side of the elastic body, and the elastic body is, at an outer peripheral portion separated from the support portion, held at the holding portion.

20 Claims, 5 Drawing Sheets

(56) References Cited

U.S. PATENT DOCUMENTS

2012/0263332 A1* 10/2012 Akino ..... H04R 19/04
381/355
2016/0050506 A1* 2/2016 Kim ..... H04R 17/025
381/56
2016/0234594 A1* 8/2016 Ogura ..... B60R 11/0247

* cited by examiner

SPEAKER DEVICE

BACKGROUND OF THE INVENTION

1. Field of the Invention

The present invention relates to a speaker device including a microphone.

2. Description of the Related Art

A device (a speaker device) including a speaker unit and a microphone in a single housing (a cabinet) has spread as, e.g., a conferencing device or an audio assistant device connected to a network (see, e.g., JP-A-2012-235264 and U.S. Pat. No. 9,390,724).

SUMMARY OF THE INVENTION

In the above-described speaker device, there is a problem that sound emitted from the speaker unit is accidentally collected by the microphone and causes noise. Of the sound emitted from the speaker unit, sound propagating to the microphone through spaces on the inside and outside of the housing can be reduced to a certain extent in such a manner that the speaker unit and the microphone are spatially divided by, e.g., a sound isolation wall. On the other hand, sound propagating from the speaker unit to the microphone through the housing propagates, as internal vibration of the housing, to the microphone or a substrate (hereinafter referred to as a "microphone substrate") on which the microphone is mounted because the speaker unit and the microphone are supported together at the housing. This leads to a problem that it is difficult to reduce such sound.

The typical technique described JP-A-2012-235264 discloses that for reducing the sound propagating from the speaker unit to the microphone, the microphone is supported at the housing with a buffer member being interposed therebetween. The buffer member used herein has a certain degree of thickness, and a longitudinal wave (a compressional wave) of the sound propagating through the housing is absorbed by elastic deformation of the buffer member in a thickness direction thereof. However, in a case where the microphone is supported at the housing with the buffer member with a certain degree of thickness being interposed therebetween as described above, the buffer member is less deformable in response to a transverse wave propagating through the housing, and therefore, cannot effectively absorb the propagating transverse wave. For this reason, there is a problem that even when the above-described butter member is interposed, majority of the sound, which propagates as the transverse wave through the housing, of the sound emitted from the speaker unit propagates to the microphone.

The present invention has been proposed to cope with these problems. That is, an object is to effectively reduce, in a speaker device including a microphone, sound propagating from a speaker unit to the microphone through a housing and reduce noise picked up by the microphone, for example.

For solving these problems, the present invention has the following configuration.

The speaker device includes a housing configured to support a speaker unit, and a film-shaped elastic body configured to support a microphone. The housing includes a holding portion configured to hold the elastic body with a distance from the microphone.

BRIEF DESCRIPTION OF THE DRAWINGS

(FIG. 4A illustrates a state before the elastic body is held at a holding portion, and FIG. 4B illustrates a state in which the elastic body is held at the holding portion); (FIG. 5A is an example where the through-hole in a radial shape is provided, and FIG. 5B is an example where the C-chamfered opening is provided).

DETAILED DESCRIPTION OF THE PREFERRED EMBODIMENTS

Figure 1:
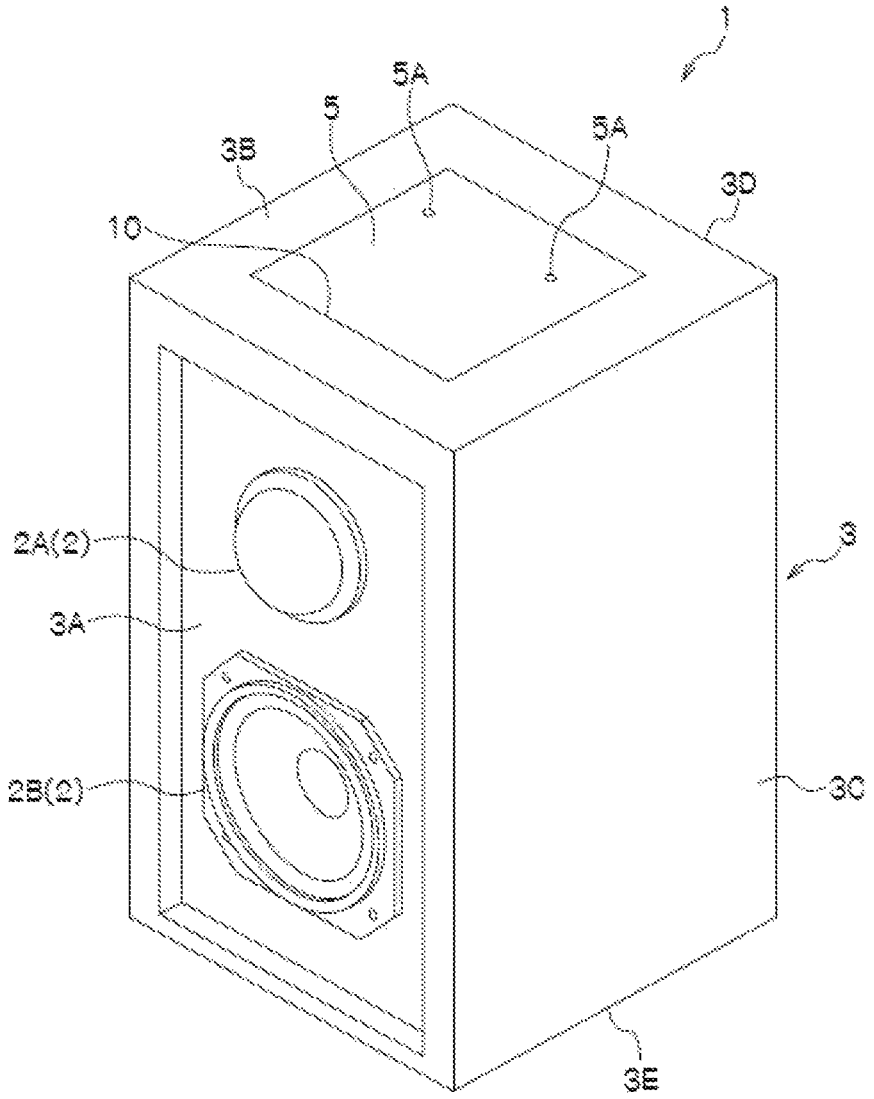
FIG. 1 is a perspective view of an outer appearance of a speaker device according to an embodiment of the present invention.

Hereinafter, an embodiment of the present invention will be described with reference to the drawings. In description below, the same reference numerals are used to represent the same functions in different figures, and overlapping description in each figure will be omitted as necessary.

Figure 2:
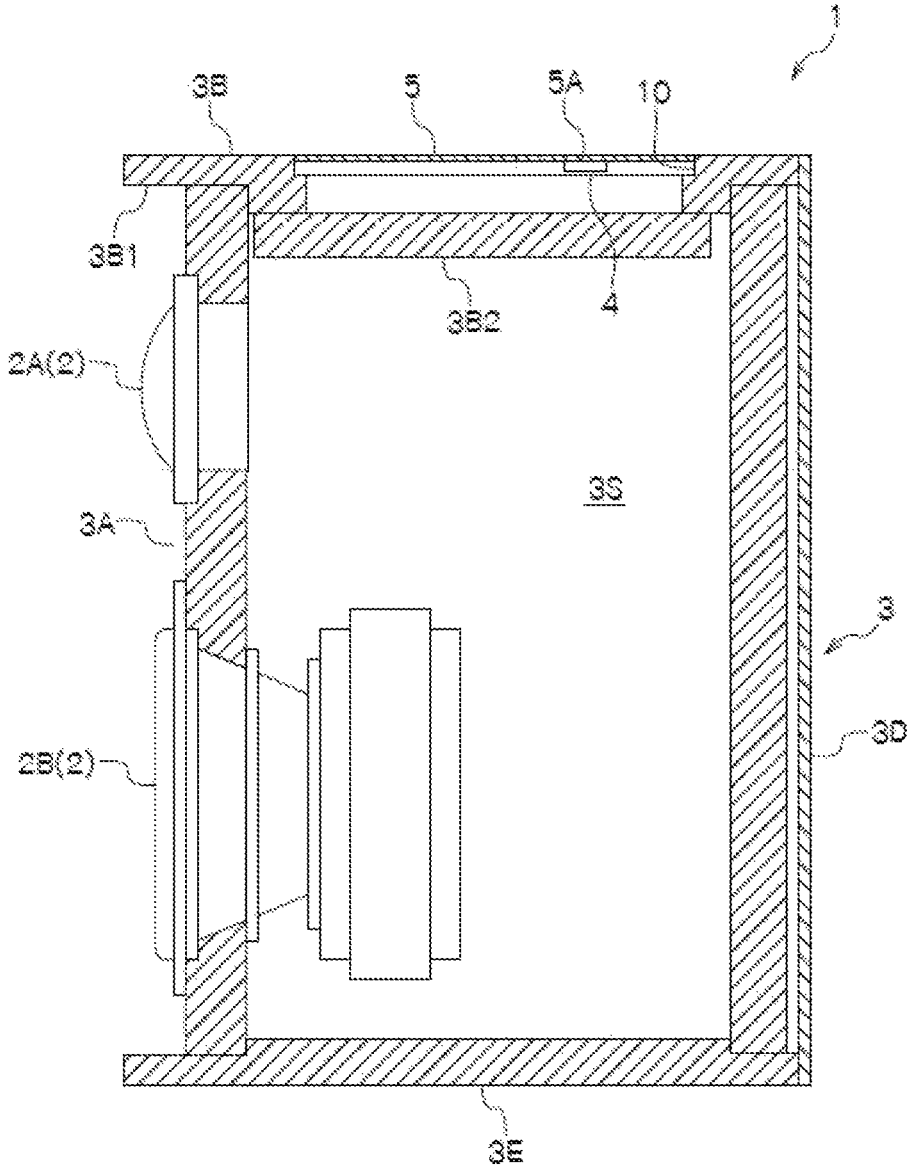
FIG. 2 is a partial sectional view of a main configuration of the speaker device according to the embodiment of the present invention.

As illustrated in FIGS. 1 and 2, a speaker device 1 includes a housing (a cabinet) 3 configured to support a speaker unit 2 (a first speaker unit 2A and a second speaker unit 2B) and a film-shaped (or a thin plate-shaped) elastic body 5 configured to support a microphone 4. Note that in FIG. 2, part of an internal structure or internal components of the housing 3 is not shown.

The illustrated speaker unit 2 is configured such that the first speaker unit 2A is a tweeter and the second speaker unit 2B is a woofer, for example. In the illustrated example, the two-way speaker unit 2 such as the tweeter and the woofer is illustrated by way of example, and the present invention is not limited to above. A three-way speaker unit 2 with an additional squawker or other speaker units 2 than above may be employed.

The housing 3 configured to support the speaker unit 2 is, in the illustrated example, in a box shape (a rectangular parallelepiped shape) having a front portion 3A, an upper portion 3B, side portions 3C, a back portion 3D, and a bottom portion 3E. The speaker unit 2 is supported at the front portion 3A. The form of the housing 3 is not limited to the illustrated example, and may be any shape such as a cylindrical shape, a truncated conical shape, a truncated pyramid shape, and a spherical shape.

The elastic body 5 configured to support the microphone 4 is a film-shaped (or a thin plate-shaped) member, and may be made of a rubber material such as natural rubber or synthetic rubber. The film shape described herein is not limited to a planar shape as illustrated in the figure, and may be in a curved shape or a corrugated shape. As illustrated in the figure, the microphone 4 supported at the elastic body 5 is supported to suspend from one side of the elastic body 5 not to contact the housing 3, and an outer peripheral portion of the elastic body 5 is held at a holding portion 10 of the housing 3.

In the illustrated figure, the holding portion 10 provided at the housing 3 is provided at the upper portion 3B of the housing 3. Moreover, the holding portion 10 is provided on an outer surface side at the upper portion 3B of the housing 3, and therefore, is isolated from an internal space 3S of the housing 3. The holding portion 10 holds the elastic body 5 such that the housing 3 is separated from the microphone 4.

The elastic body 5 has a through-hole 5A for inputting sound to the microphone 4. The microphone 4 is supported at the periphery of the through-hole 5A on one side of the elastic body 5, and the elastic body 5 is, at the outer peripheral portion separated from the microphone 4, held at the holding portion 10. Supporting of the microphone 4 at the elastic body 5 is, through an adhesive or a double-sided adhesive material, performed directly or performed through a microphone substrate as described later.

The speaker device 1 described above is configured such that sound is emitted from the speaker unit 2 to the outside based on an audio signal transmitted from, e.g., a not-shown signal processing unit in the housing 3 to the speaker unit 2. Moreover, sound input to the speaker device 1 reaches the microphone 4 through the through-hole 5A of the elastic body 5, and a signal converted by the microphone 4 is transmitted to, e.g., the not-shown signal processing unit. In this state, the sound emitted from the speaker unit 2 is sound different from the input sound which needs to be picked up by the microphone 4, and therefore, is noise for the microphone 4. In the speaker device 1, arrangement of the microphone 4 is designed such that the microphone 4 does not pick up such noise.

First, the speaker unit 2 is supported at the housing 3, and therefore, the sound emitted from the speaker unit 2 propagates as internal vibration of the housing 3. For preventing such internal vibration from reaching the microphone 4, the microphone 4 is supported at the film-shaped elastic body 5, and the outer peripheral portion of the elastic body 5 is held at the holding portion 10 of the housing 3 with the microphone 4 being separated from the housing 3. The holding portion 10 supports the film-shaped elastic body 5 so that the elastic body 5 can vibration in the direction perpendicular to the film.

According to the structure for supporting the microphone 4 as described above, a sound transverse wave component of the internal vibration propagating from the speaker unit 2 through the housing 3 vibrates the film-shaped elastic body 5 in the direction perpendicular to the film surface, thereby deforming the elastic body 5. An internal loss upon deformation of the elastic body 5 as described above attenuates the sound transverse wave component propagating through the housing 3. Note that a sound longitudinal wave component propagates through the elastic body 5, but less propagates due to the thin film shape of the elastic body 5. As described above, the internal loss of the elastic body 5 can effectively reduce the noise picked up by the microphone 4. The thickness of the elastic body 5 described above can be set to 2 mm, for example.

The speaker device 1 effectively shields part of the sound emitted from the speaker unit 2, the part being sound propagating toward the microphone 4 in spaces on the inside and outside of the housing 3. Specifically, for direct sound propagating in the internal space 3S of the housing 3, the holding portion 10 configured to hold the elastic body 5 is provided on the outer surface side at the upper portion 3B of the housing 3, and therefore, an inner wall 3B2 of the upper portion 3B serves as a sound insulation wall. The direct sound can be more effectively shielded by arrangement of a sound absorbing material on the inside or outside of the upper portion 3B.

For diffracted sound, which propagates toward the microphone 4 in the external space of the housing 3, of the sound emitted from the speaker unit 2, the front portion 3A at which the speaker unit 2 is supported is recessed inward of an upper end portion 3B1 of the upper portion 3B, and therefore, the upper end portion 3B1 serves as a sound insulation wall. This shields sound propagating around to above the upper portion 3B. In this state, a hole direction of the through-hole 5A provided at the elastic body 5 is substantially perpendicular to a vibration direction of a diaphragm at the speaker unit 2, and therefore, noise of the above-described diffracted sound picked up by the microphone 4 is effectively reduced.

Figure 3:
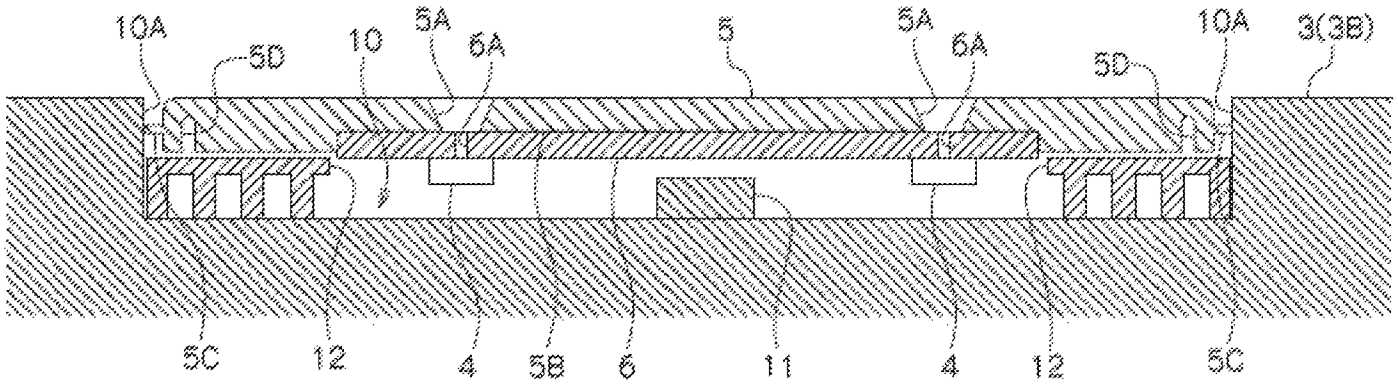
FIG. 3 is a sectional view of a specific structure for supporting microphones in the speaker device.

FIG. 3 more specifically illustrates the structure for supporting the microphone 4. In this example, the film-shaped elastic body 5 has two through-holes 5A, and a support portion 5B is provided around the through-holes 5A on one side of the elastic body 5. Moreover, the elastic body 5 is, at the outer peripheral portion separated from the support portion 5B, held at the holding portion 10 of the housing 3. The support portion 5B described herein is a recessed portion provided on one side of the elastic body 5, and is provided at a thin portion of the elastic body 5 including the through-holes 5A. As described above, the thin portion of the elastic body 5 is formed as the support portion 5B, and therefore, the microphone 4 can be positioned closer to the outside of the elastic body 5. Thus, the input sound easily reaches the microphone 4. The thickness of the thin portion in this state can be set to 1.5 mm, for example.

The microphones 4 are supported at the support portion 5B of the elastic body 5 through the microphone substrate 6. Specifically, one side of the microphone substrate 6 is fixed to an inner surface of the support portion 5B with the adhesive or the double-sided adhesive material, and the microphones 4 are mounted on the other side of the microphone substrate 6. Openings 6A are formed at the microphone substrate 6. The openings 6A are formed to face the microphones 4 and to overlap with the through-holes 5A of the elastic body 5. Each through-hole 5A is configured such that an outer hole diameter is greater than a hole diameter on the side provided with the support portion 5B. The outer hole diameter of the through-hole 5A is formed greater as described above, and therefore, the input sound easily enters the microphones 4.

The holding portion 10 provided at the housing 3 is formed in such a recessed shape that the elastic body 5 is housed. Thus, the elastic body 5 forms part of an outer surface of the housing 3. Moreover, a contact portion 11 configured to limit elastic depression of the elastic body 5 is provided at the holding portion 10. The contact portion 11 is a mechanical stopper configured to limit the depression such that the microphones 4 do not contact the housing 3 even in a case where the elastic body 5 is depressed in response to pressing force or that the microphone substrate 6 bonded to the elastic body 5 is not detached due to excessive deformation of the elastic body 5. In the illustrated example, the contact portion 11 is arranged at a position (between two microphones 4) not contacting two microphones 4, and comes into contact with the microphone substrate 6 when the elastic body 5 is depressed. However, the contact portion 11 may be arranged at a position facing the microphone 4 as long as the contact portion 11 does not contact the microphone 4. In this example, the contact portion 11 protruding toward the microphone substrate 6 is provided on a housing 3 side (a holding portion 10 side). Conversely, a contact portion protruding toward the housing 3 side beyond the height of the microphone 4 may be provided on a microphone substrate 6 side.

The elastic body 5 is, at the holding portion 10 of the housing 3, held such that the microphones 4 are surrounded by the outer peripheral portion of the elastic body 5. The outer peripheral portion of the elastic body 5 may be directly held on an inner surface of the holding portion 10, or may be held through holding members 12 arranged in the holding portion 10. The elastic body 5 is held at the outer peripheral portion thereof, and therefore, the inside of the outer peripheral portion on which the microphones 4 are supported is easily deformable. The internal loss due to such deformation can effectively absorb the transverse wave component of the sound toward the microphones 4. Note that no airtightness is necessary for holding of the elastic body 5 at the holding portion 10, and the elastic body 5 may be vibratable (deformable) in the film shape.

Figure 4A:
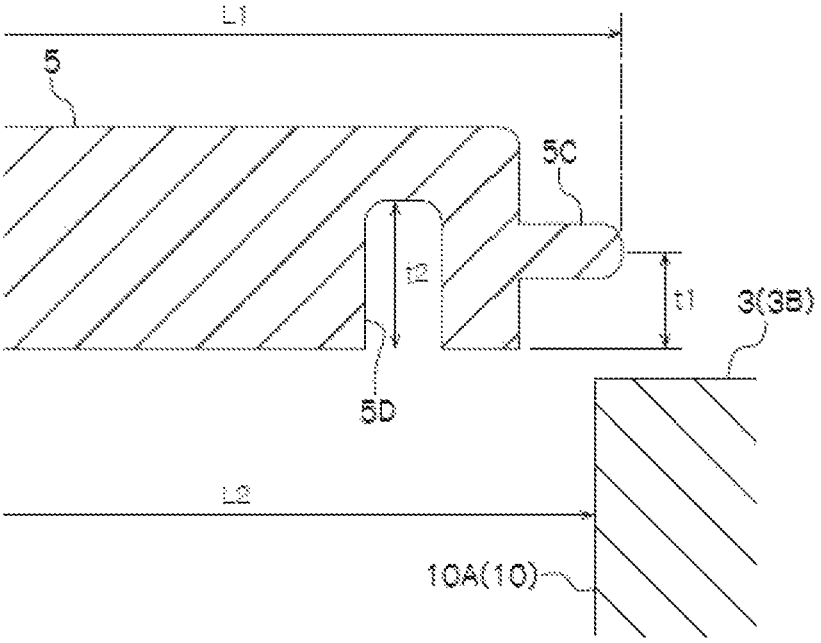
FIGS. 4A and 4B are sectional views of an outer peripheral portion of an elastic body in the speaker device
Figure 4B:
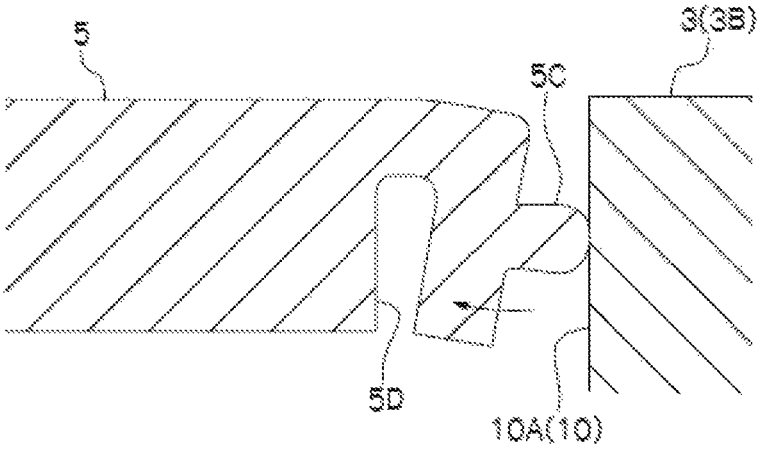

As illustrated in FIGS. 3, 4A, and 4B, the elastic body 5 includes, at an outer peripheral edge thereof, a raised portion 5C protruding toward the inner surface 10A of the holding portion 10. Moreover, the elastic body 5 includes, at the outer peripheral portion near the outer peripheral edge, a groove portion 5D deeper than the position of the raised portion 5C. The raised portion 5C and the groove portion 5D are formed across the entire circumference of the outer peripheral portion of the elastic body 5. As illustrated in FIG. 4A, the groove depth (a distance from an inner surface of the elastic body 5 to a groove end of the groove portion 5D) t2 of the groove portion 5D is set greater than a distance t1 from the inner surface of the elastic body 5 to the center position of the raised portion 5C.

As illustrated in FIG. 4A, the elastic body 5 is configured such that the transverse width L1 of the elastic body 5 is slightly greater than the inner width L2 of the holding portion 10. Thus, when the elastic body 5 is housed in the holding portion 10, the outer peripheral edge of the elastic body 5 is, as illustrated in FIG. 4B, inclined due to crushing of the groove portion 5D, and the elastic body 5 is housed with the outer peripheral portion of the elastic body 5 bending inward of the holding portion 10. This can eliminate a defect leading to easy detachment of the outer peripheral edge of the elastic body 5 from the holding portion 10 due to outward protrusion of the elastic body 5, and can house the elastic body 5 in the holding portion 10 without clearance. Even in a case where the housing 3 or the elastic body 5 deforms due to, e.g., thermal expansion or moisture absorption/drying, the raised portion 5C and the groove portion 5D follow such deformation to deform. Thus, the elastic body 5 can be continuously housed in the holding portion 10 without clearance.

Figure 5A:
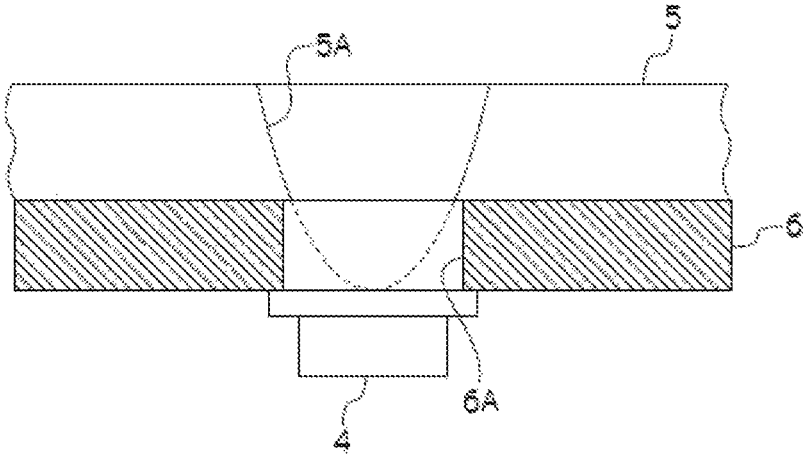
FIGS. 5A and 5B are views for describing a through-hole provided at the elastic body and an opening provided at a microphone substrate
Figure 5B:
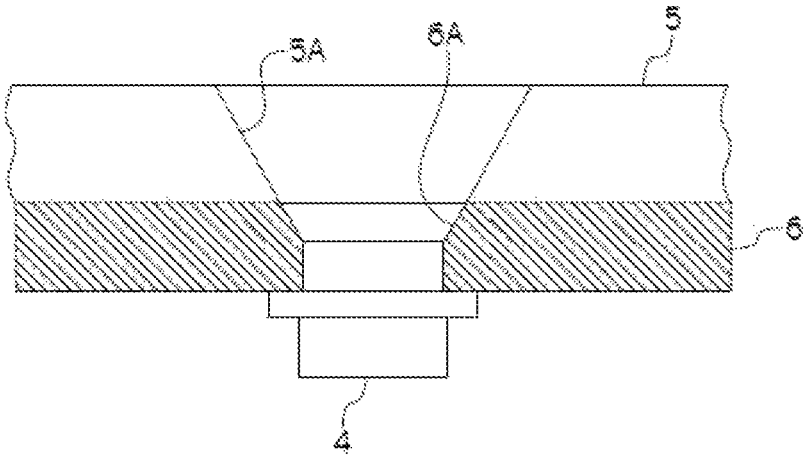

FIGS. 5A and 5B illustrate form examples of the through-hole 5A provided at the elastic body 5 and the opening 6A provided at the microphone substrate 6. In the example illustrated in FIG. 5A, a longitudinal section of the through-hole 5A is in a radial shape. According to this example, the input sound entering through the through-hole 5A is collected along an inner surface of the through-hole 5A, and therefore, can be concentrated on a single point on the microphone 4. In addition, a standing wave on the inner surface of the through-hole 5A can be reduced. Thus, the effect of collecting the input sound can be enhanced.

In the example illustrated in FIG. 5B, the through-hole 5A is configured such that the outer hole diameter thereof is greater than an inner hole diameter, and an inclined inner surface (a C-chamfered surface) is provided at the opening 6A provided at the microphone substrate 6. With this shape of the opening 6A, an inlet portion of the opening 6A formed at the microphone substrate 6 can be expanded to the maximum extent for the through-hole 5A. Thus, the effect of collecting the input sound can be also enhanced. Note that in the illustrated example, the through-hole 5A has the inclined inner surface along the opening 6A. In a case where the through-hole 5A is a straight hole larger than the opening 6A, the sound collection effect can be also improved as in the illustrated example. The inclined inner surface is provided at the microphone substrate 6 as described above, and therefore, the sound collection effect can be improved at low cost.

The embodiments of the present invention have been described above in detail with reference to the drawings, but a specific configuration is not limited to these embodiments. Even a design change etc. without departing from the gist of the present invention are included in the present invention. Moreover, the above-described embodiments can be combined using the techniques thereof as long as there is no inconsistency or problem in the object, configuration, etc. of each embodiment.

What is claimed is:

1. A speaker device comprising:

a housing configured to support a speaker unit; and a film-shaped elastic body configured to support a microphone by holding the microphone, wherein the housing includes a holding portion configured to hold the elastic body with a distance from the microphone, and the holding portion is configured to hold the elastic body with the distance from the microphone such that both the elastic body and the microphone held by the elastic body are vibratable in a direction perpendicular to a film.

2. The speaker device according to claim 1, wherein the film-shaped elastic body is vibratable in a direction perpendicular to a film.

3. The speaker device according to claim 1, wherein the elastic body has a through-hole, a support portion on which the microphone is supported is provided around the through-hole on one side of the elastic body, and the elastic body is, at an outer peripheral portion separated from the support portion, held at the holding portion.

4. The speaker device according to claim 3, wherein the support portion is provided at a thin portion of the elastic body.

5. The speaker device according to claim 3, wherein the through-hole is configured such that an outer hole diameter is greater than a hole diameter on a side provided with the support portion.

6. The speaker device according to claim 3, wherein the microphone is supported at the elastic body through a substrate, and the substrate has an opening facing the microphone and overlapping with the through-hole.

7. The speaker device according to claim 6, wherein the opening has such an inclined inner surface that a diameter on a through-hole side is greater.

8. The speaker device according to claim 1, wherein the holding portion is formed in such a recessed shape that the elastic body is housed.

9. The speaker device according to claim 1, wherein the elastic body forms part of an outer surface of the housing.

10. A speaker device comprising:

a housing configured to support a speaker unit; and a film-shaped elastic body configured to support a microphone, wherein the housing includes a holding portion configured to hold the elastic body with a distance from the microphone, and the elastic body includes, at an outer peripheral edge thereof, a raised portion protruding toward an inner surface of the holding portion, and includes a groove portion at the outer peripheral portion near the outer peripheral edge.

11. The speaker device according to claim 10, wherein the film-shaped elastic body is vibratable in a direction perpendicular to a film.

12. The speaker device according to claim 10, wherein the elastic body has a through-hole, a support portion on which the microphone is supported is provided around the through-hole on one side of the elastic body, and the elastic body is, at an outer peripheral portion separated from the support portion, held at the holding portion.

13. The speaker device according to claim 12, wherein the support portion is provided at a thin portion of the elastic body.

14. The speaker device according to claim 12, wherein the through-hole is configured such that an outer hole diameter is greater than a hole diameter on a side provided with the support portion.

15. The speaker device according to claim 12, wherein the microphone is supported at the elastic body through a substrate, and the substrate has an opening facing the microphone and overlapping with the through-hole.

16. A speaker device comprising:

a housing configured to support a speaker unit; and a film-shaped elastic body configured to support a microphone, wherein the housing includes a holding portion configured to hold the elastic body with a distance from the microphone, a contact portion configured to limit elastic depression of the elastic body is provided at the holding portion.

17. The speaker device according to claim 16, wherein the film-shaped elastic body is vibratable in a direction perpendicular to a film.

18. The speaker device according to claim 16, wherein the elastic body has a through-hole, a support portion on which the microphone is supported is provided around the through-hole on one side of the elastic body, and the elastic body is, at an outer peripheral portion separated from the support portion, held at the holding portion.

19. The speaker device according to claim 18, wherein the support portion is provided at a thin portion of the elastic body.

20. The speaker device according to claim 18, wherein the through-hole is configured such that an outer hole diameter is greater than a hole diameter on a side provided with the support portion.

* * * * *